US011173509B2

(12) United States Patent
Flynn et al.

(10) Patent No.: US 11,173,509 B2
(45) Date of Patent: Nov. 16, 2021

(54) PUMP LOCKING RETENTION FEATURES AND METHODS OF USING THE SAME

(71) Applicant: Silgan Dispensing Systems Corporation, Grandview, MO (US)

(72) Inventors: Leah Flynn, Grandview, MO (US); Alejandro Espinoza, Grandview, MO (US); Joseph K. Dodd, Grandview, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 0 days.

(21) Appl. No.: 16/621,220

(22) PCT Filed: Jun. 8, 2018

(86) PCT No.: PCT/US2018/036616

§ 371 (c)(1),
(2) Date: Dec. 10, 2019

(87) PCT Pub. No.: WO2018/231642

PCT Pub. Date: Dec. 20, 2018

(65) Prior Publication Data

US 2020/0094278 A1 Mar. 26, 2020

Related U.S. Application Data

(60) Provisional application No. 62/518,188, filed on Jun. 12, 2017.

(51) Int. Cl.
*B05B 11/00* (2006.01)

(52) U.S. Cl.
CPC ..... *B05B 11/306* (2013.01); *B05B 11/3002* (2013.01)

(58) Field of Classification Search
CPC ..... B05B 11/306; B05B 11/3002; B05B 11/3074; B05B 11/3023
See application file for complete search history.

(56) References Cited

U.S. PATENT DOCUMENTS

| | | | | |
|---|---|---|---|---|
| 4,991,746 | A | 2/1991 | Schultz | |
| 5,615,806 | A | 4/1997 | Grothoff | |
| 8,439,230 | B2 * | 5/2013 | Hagen | B05B 11/3021 222/153.13 |
| 8,505,778 | B2 * | 8/2013 | Welp | B05B 11/3059 222/153.04 |
| 10,040,083 | B2 * | 8/2018 | Barenhoff | B05B 11/3059 |
| 2017/0021376 | A1 * | 1/2017 | Espinoza | B05B 11/3023 |
| 2017/0128966 | A1 * | 5/2017 | Law | B05B 11/0027 |
| 2019/0118205 | A1 * | 4/2019 | Knight | B05B 11/3074 |
| 2020/0139391 | A1 * | 5/2020 | Knight | B05B 11/306 |

FOREIGN PATENT DOCUMENTS

| | | | |
|---|---|---|---|
| CN | 1233579 | A | 11/1999 |
| EP | 0887304 | B1 | 9/2002 |
| WO | 9112895 | A1 | 9/1991 |
| WO | 2006100027 | A1 | 9/2006 |

* cited by examiner

*Primary Examiner* — Donnell A Long
(74) *Attorney, Agent, or Firm* — Barlow Josephs & Holmes, Ltd.; Stephen J. Holmes

(57) ABSTRACT

Locking features of a pump system may include projections and corresponding features on a piston stem and lock cylinder of a pump system such that the features are configured to require an increased amount of force to rotate and unlock the piston stem from the lock cylinder.

6 Claims, 10 Drawing Sheets

PUMP LOCKING RETENTION FEATURES AND METHODS OF USING THE SAME

BACKGROUND OF THE DISCLOSURE

Field of the Invention

Embodiments of the present invention. relate to locking features utilized with various pumps and more particularly to features designed to increase and/or improve locking retention for e-commerce applications.

State of the Art

Many different types of pumps are sold and used in various commerce streams. Some of these pumps include locking features which are configured to allow a pump to operate or pump fluid in one or more configurations or positions and to prevent operation of the pump in one or more alternative locked positions.

For example, many different types of pumps used to deliver soap, lotions, or other fluid or pasty products through a pump head connected to a pump employ a pump having a first, locked position and a second, unlocked position. In many cases, a pump head may be rotated to move the pump from the first, locked position to the second, unlocked position. In some versions of pumps, the pump may be locked in an up position or in a down position. In other versions, a pump may be locked in either the up position or in the down position.

While locking features are well known and many pumps employ various locking features and configurations, such features are typically easily unlocked and relocked. While this may be desirable, the advent and increased use of electronic commerce—or e-commerce—delivery options has resulted in a number of leakage problems for companies shipping product having locking pumps. In many instances, such pumps are becoming unlocked during handling, shipment, and delivery of the products, resulting in leakage or unintended disbursement of product through the pumping systems.

Thus, it is desirable to improve the locking features used with various pumps and pump systems. It is also desirable to improve the locking features with adding significant cost or requiring significant increases in the amount of force required to use such pumps and pump products.

SUMMARY OF THE INVENTION

According to certain embodiments of the invention, a lock cylinder and piston stem used with a pump or pump assembly include corresponding interacting locking features that may work together or interfere with one another to increase the amount of torque or force needed to unlock a piston stem from a lock cylinder of a pump system.

According to some embodiments of the invention, a lock cylinder may include a ramp or bump located in. a locking groove thereof that may interact with a corresponding locking notch on a piston stem. The locking notch may interact with the bump or ramp to secure the piston stem in a locked position with the lock cylinder until a certain force is overcome to disengage the locking notch and locking groove.

In other embodiments of the invention, a locking projection on the piston stem may interact with a bump or ramp on the lock cylinder to increase the force required to unlock the piston stem from the lock cylinder. In other embodiments, the lock cylinder may include a locking projection that interacts with a locking feature of the piston stem.

In other embodiments of the invention, a piston stem locking feature may be hollow or partially hollow and configured to catch a bump, ramp, or projection off of a surface of the lock cylinder. When engaged, the bump, ramp, or projection may interact with an interior of the piston locking feature to prevent movement and unlocking of the piston stem until a certain force is reached.

In still other embodiments, a lock cylinder may include a leaf spring feature that may apply a force against a locking feature of a piston stem to help retain the piston stem in a locked position.

According to other embodiments of the invention, additional frictional feature and contact points may be added to components of a pump assembly to increase the force required to disengaged a locked piston stem and lock cylinder. In some embodiments, projections or wedges on the lock cylinder may push against a portion of a piston stem to increase sealing forces between the two parts and thereby increase the force required to rotate the parts relative to one another. In other embodiments, a closure and head may include corresponding features configured to prevent or hinder rotation of the head relative to a closure without sufficient force.

In still other embodiments, clips may be used to prevent movement of a pump head relative to the closure until the clip is removed.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
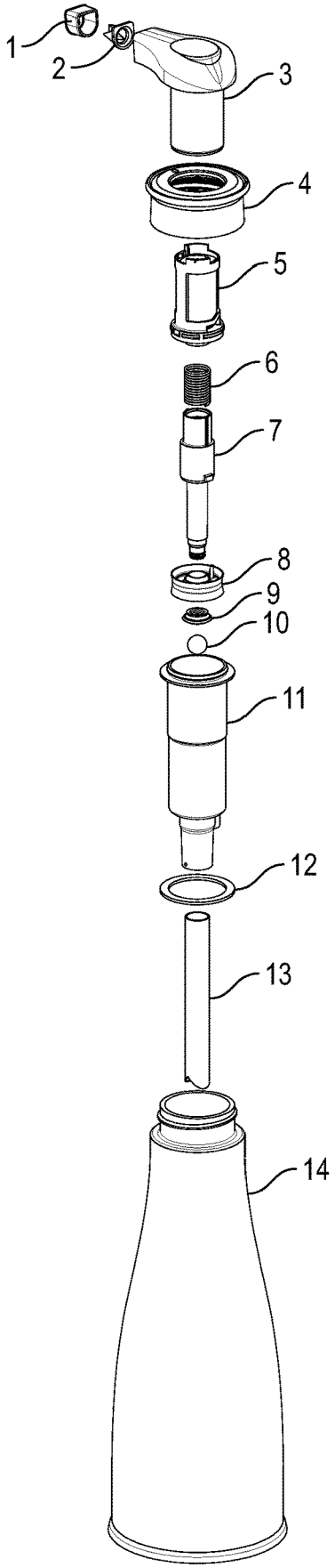
FIG. 1 illustrates the components of a pump assembly.

A conventional pump assembly is illustrated in FIG. 1. While various components of the pump assembly are illustrated, it is understood that a pump assembly may include additional or fewer components and that the components may include alternative features. While various embodiments of the invention are described with respect to the pump assembly components illustrated in FIG. 1, it is understood that the embodiments of the invention may be adapted, used, and included on other components for pump systems and closures.

As illustrated in FIG. 1, a pump system may include a bottle 14 having a pump attached thereto. A pump assembly may include a pump head 3 having an orifice. A discharge valve 2 may be held in the orifice by a valve retainer 1. The head 3 may be connected to a piston stem 7 and be seated within an interior of the accumulator 11. A lock cylinder 5 may also be seated within the accumulator 11 and fixed thereto. A spring 6 may be seated between the head 3 and the lock cylinder 5, applying a force against the head 3 of the pump to push it away from the lock cylinder 5. A closure 4 may be connected to the accumulator 11 and used to secure the pump system to the bottle 14. A gasket 12 may sit between a surface of the accumulator 11 and the bottle 14 to create a seal therebetween and to prevent leaks. A piston 8 may be affixed to the piston stem 7 along with a plug seal 9. A ball 10 or other valve system may be seated in the accumulator 11 to create a valve through which product may flow from an interior of the bottle 14 into an interior of the accumulator 11. A clip tube 13 may also be connected to the accumulator 11 to facilitate flow of product into the pump system as known.

Figure 2:
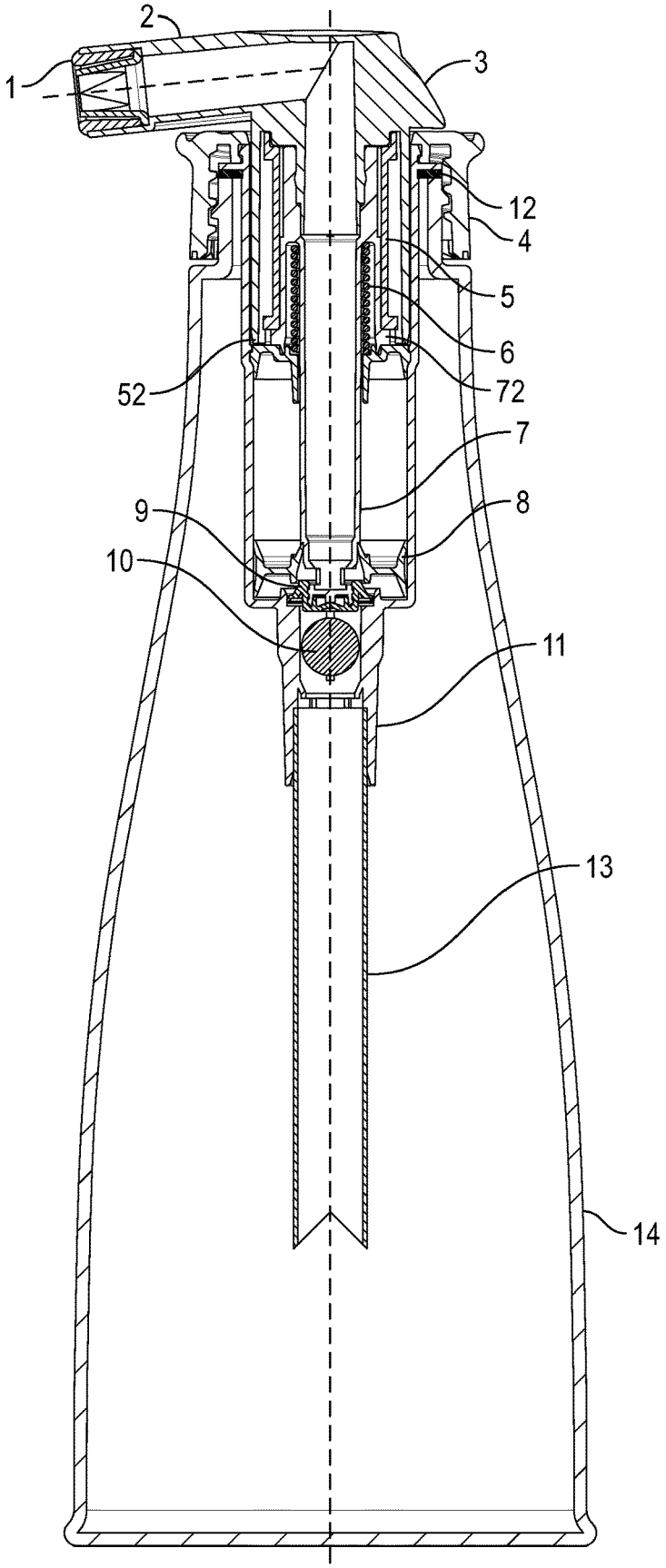
FIG. 2 illustrates a cross-sectional view of an assembled pump and bottle.

A pump system, in an assembled state, is illustrated in cross-sectional view in FIG. 2. As illustrated, the pump is in a locked position. The lock cylinder 5 of the pump system includes a groove 52 or opening into which a corresponding lock feature or locking tab 72 of the piston stem 7 sits or rides. Rotation of the head 3 of the pump illustrated in FIG. 2 moves the lock feature (locking tab) 72 in the groove 52 until the pump reaches an unlocked position wherein the locking tab 72 is outside of the groove 52 or is positioned in an alternate part of the groove 52 which allows the piston stem 7 to move relative to the lock cylinder 5. As illustrated, and in many conventional pumps, the locking tab 72 is typically just a square, rectangle, or other shape configured to fit into a corresponding groove 52 in the lock cylinder 5.

Figure 3:
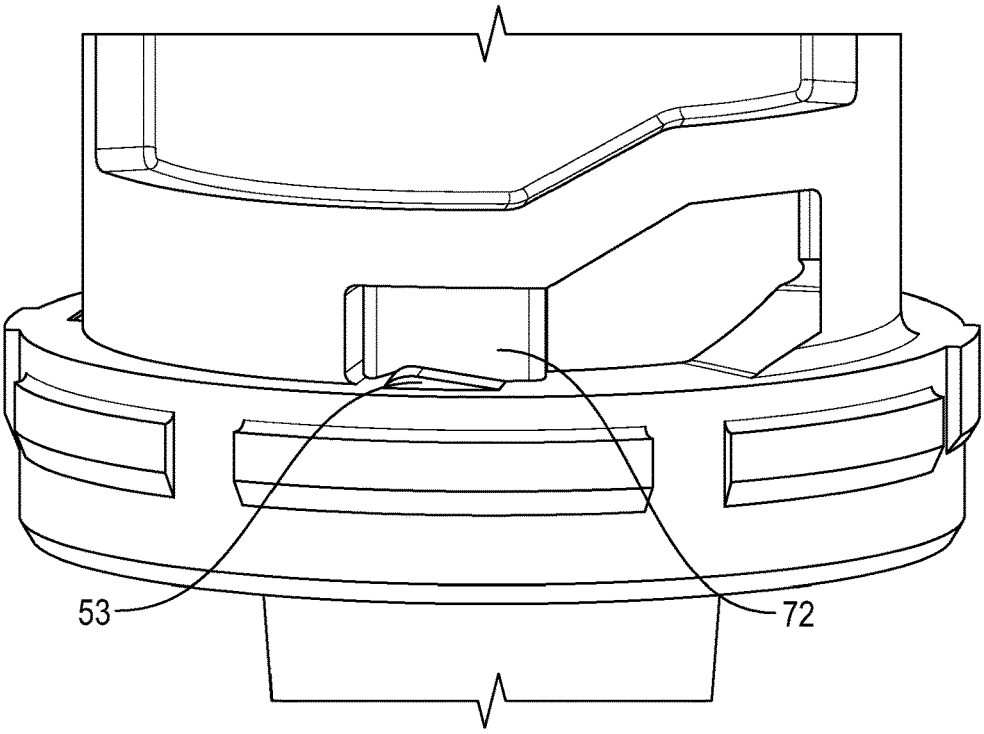
FIG. 3 illustrates a piston stem and lock cylinder assembly according to various embodiments of the invention.
Figure 4:
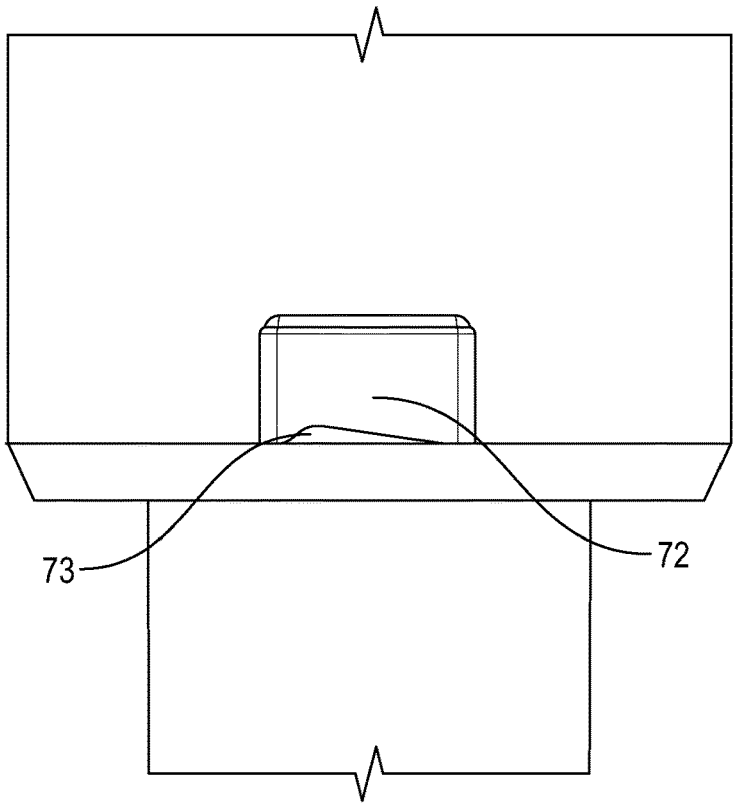
FIG. 4 illustrates a portion of a piston stem and locking feature according to various embodiments of the invention.
Figure 5:
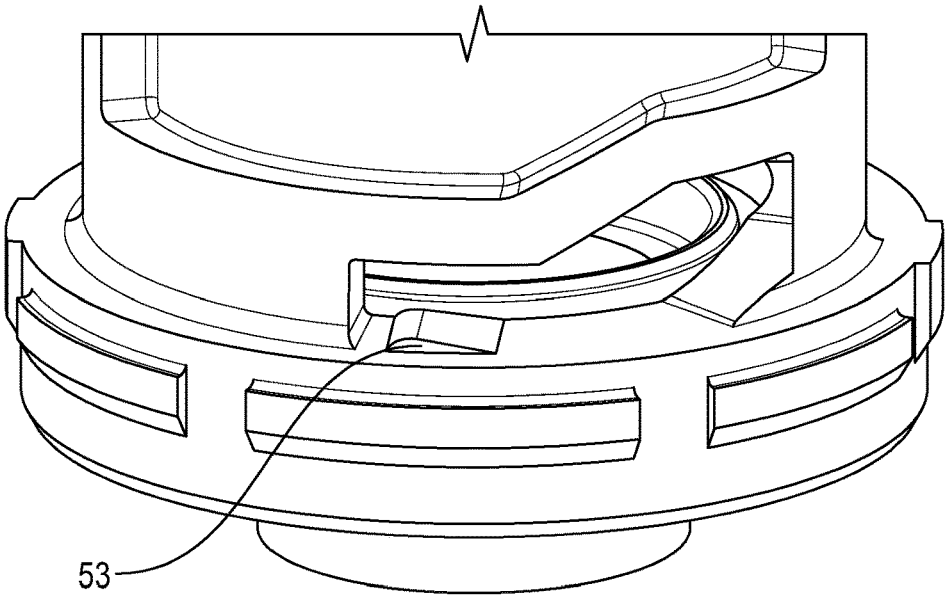
FIG. 5 illustrates a portion of a locking cylinder and a locking feature according to various embodiments of the invention.

According to some embodiments of the invention, a lock cylinder 5 may include one or more locking bumps 53 positioned along a groove 52 and configured to mate with one or more locking notches 73 on a locking tab 72 of a piston stem 7 as illustrated in FIGS. 3 through 5. A pump system having a locking bump 53 and a locking notch 73 engaged in a locking position is illustrated in FIG. 3. As seen in FIG. 4, the lock feature (locking tab) 72 of the piston stem 7 may include a locking notch 73 carved or formed therein. The locking cylinder 5 may include a corresponding locking bump 53 as illustrated in FIG. 5. In some embodiments, the locking notch 73 and locking bump 53 may be in the shape of a ramp as illustrated.

The pump system illustrated in FIGS. 3 through 5 provides a locking feature that is more difficult to disengage from a locked position because of the interaction of the locking bump 53 with the locking notch 73. Thus, in order to unlock the pump system, a user must overcome the force necessary to disengage the locking notch 73 from the locking bump 53.

Figure 6:
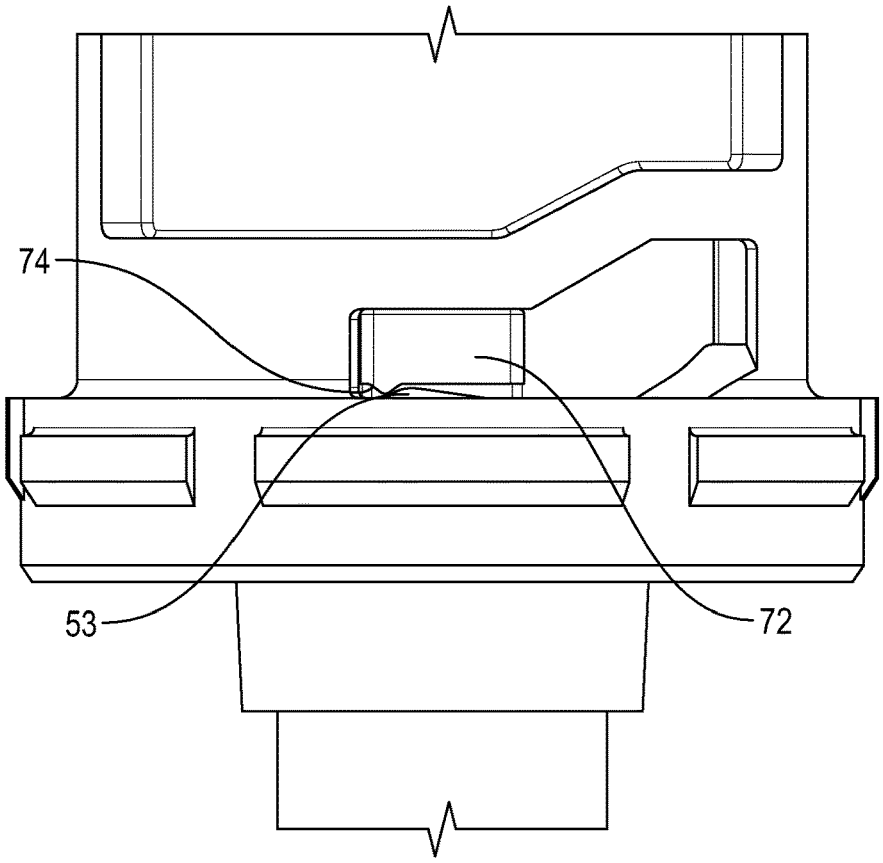
FIG. 6 illustrates a portion of a piston stem and locking feature according to various embodiments of the invention.
Figure 7:
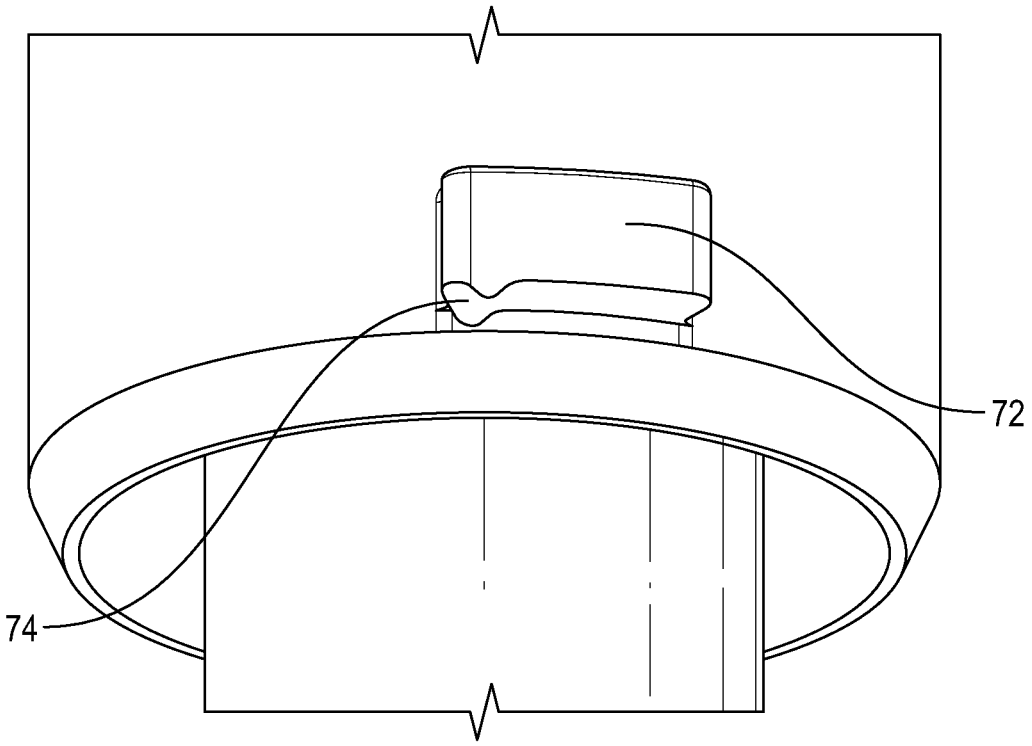
FIG. 7 illustrates a portion of a piston stem and locking feature according to various embodiments of the invention.

Another embodiment of the invention is illustrated in 6 and 7. Similar to the embodiment illustrated in FIGS. 3 through 5, the locking cylinder 5 may include one or more locking bumps 53. In some embodiments, a locking bump 53 may be shaped as a ramp as illustrated in FIG. 6. The piston stem 7 may include a lock feature (locking tab) 72 and the lock feature 72 may include a locking projection 74 configured to interact with the locking bump 53. For example, the lock feature 72 illustrated in FIG. 7 projects off of a bottom portion of the lock feature 72 of the piston stem 7 and interacts with the locking bump 53 of the lock cylinder 5 as illustrated in FIG. 6.

In addition, the lock feature 72 of the piston stem 7 may have a shorter or narrower width than other locking tab 72. For example, when comparing the locking tab 72 illustrated in FIGS. 6 and 7 with those illustrated in FIGS. 3 and 4, it can be seen that a bottom portion of the locking tab 72 is removed in the embodiment illustrated in FIGS. 6 and 7. Removal of a portion of the locking tab 72 saves on material cost and allows for easy molding of the piston stem 7.

Figure 8:
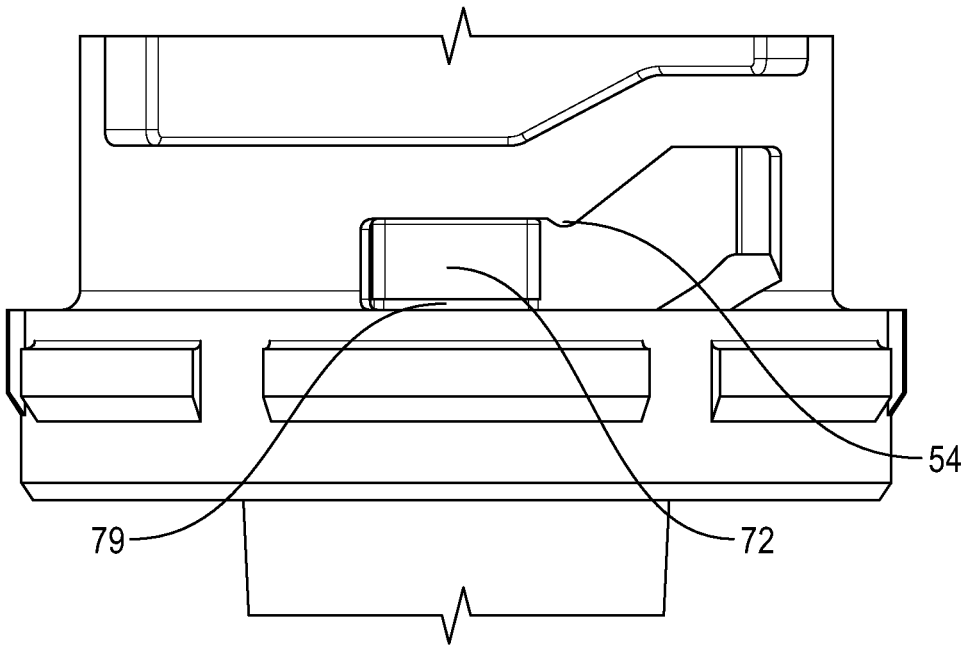
FIG. 8 illustrates a portion of a piston stem and lock cylinder assembly according to various embodiments of the invention.

An alternate locking system according to various embodiments of the invention is illustrated in FIG. 8. As illustrated, the piston stem 7 may include a locking feature (locking tab) 72 configured to include a gap 79 or space between a bottom portion thereof and the locking cylinder groove 52 when engaged in the groove 52. The lock cylinder 5 may include a locking projection 54 extending off of an upper surface of the groove 52. When the locking cylinder 5 and piston stem 7 are engaged in a locked position, the locking tab 72 of the piston stem 7 may be prohibited from passing the locking projection 54 of the lock cylinder 5 unless additional rotational force is applied by the user. As such force is applied, the locking projection 54 may push the locking tab 72 downwards so that it can pass the locking projection 54 and move into an unlocked configuration. The gap 79 space may be configured to allow the piston stem 7 to move downward and pass by the locking projection 54.

While the locking system illustrated in FIG. 8 shows the locking projection 54 on an upper surface of the groove 52 of the lock cylinder 5 and gap 79 between the locking tab 72 of the piston stem 7 and the bottom surface of the lock cylinder 5 groove 52, the opposite could also be used. In other words, the locking projection 74 could extend off of the bottom surface of the groove 52 and the locking tab 72 of the piston stem 7 could include a gap 79 adjacent the upper surface of the groove 52.

Figure 9:
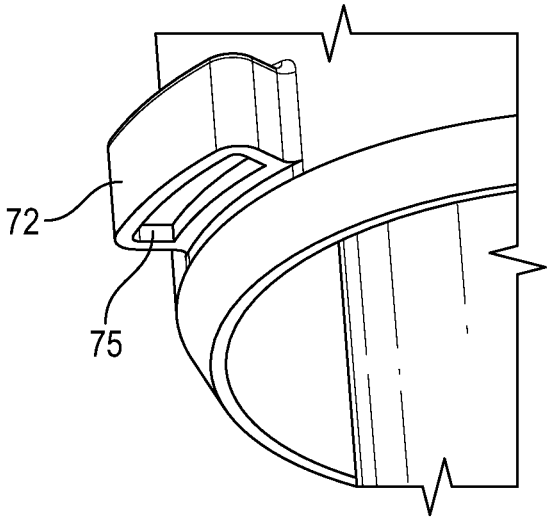
FIG. 9 illustrates a portion of a piston stem and locking feature according to various embodiments of the invention.
Figure 10:
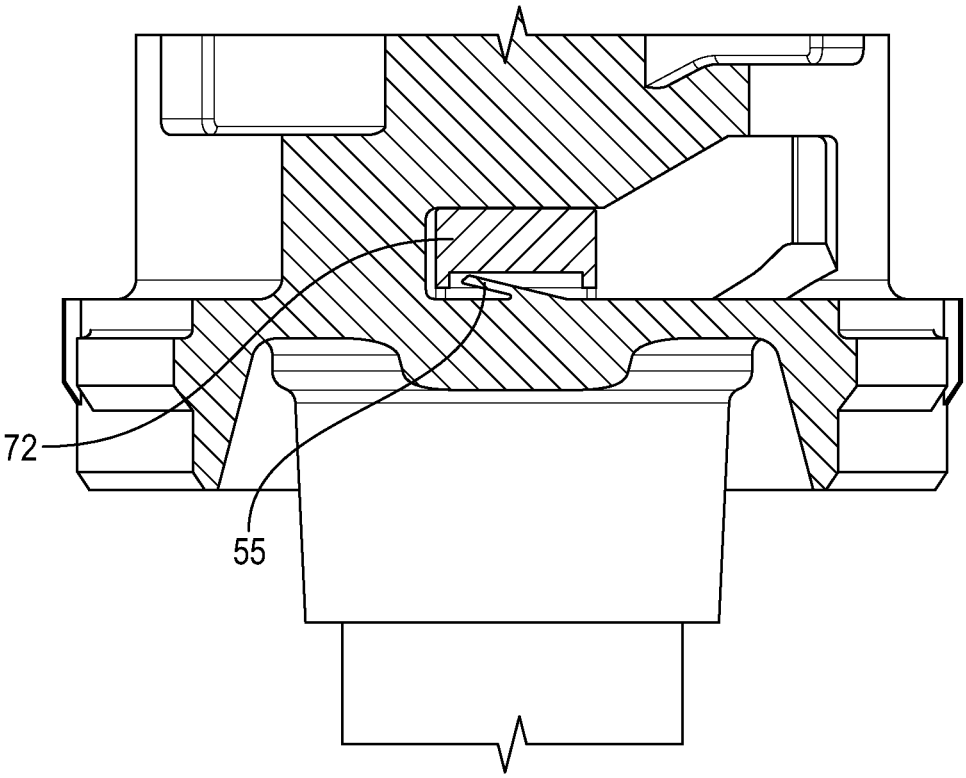
FIG. 10 illustrates a portion of a piston stem and lock cylinder assembly according to various embodiments of the invention.
Figure 11:
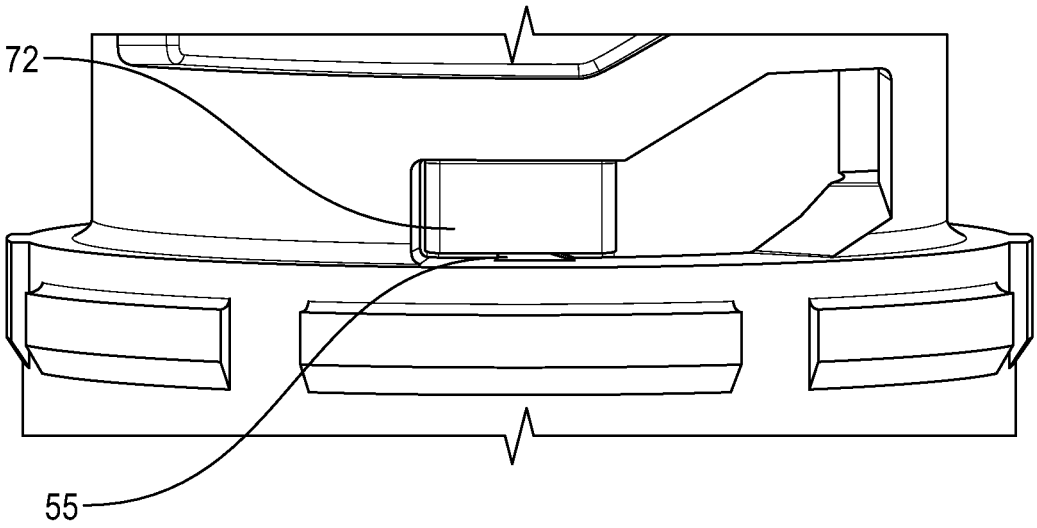
FIG. 11 illustrates a portion of a piston stem and lock cylinder assembly according to various embodiments of the invention.
Figure 12:
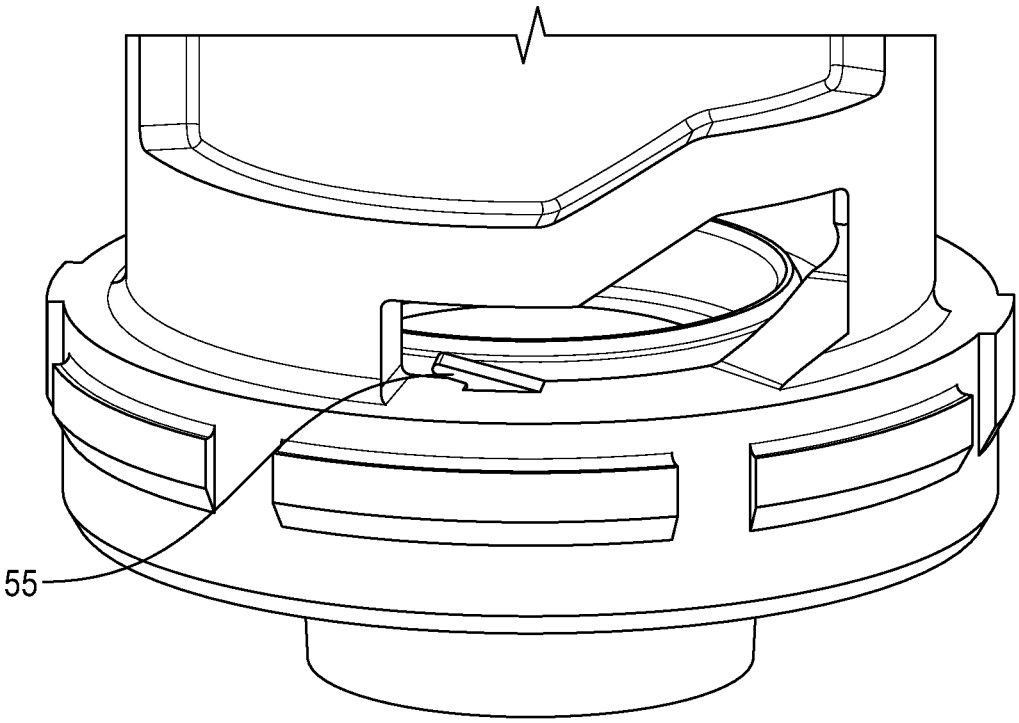
FIG. 12 illustrates a portion of a lock cylinder and locking feature according to various embodiments of the invention.

According to still other embodiments of the invention, a piston stem 7 may include a cored out or hollow locking tab 72 as illustrated in FIG. 9. The cored out locking feature 75 may be configured to mate with a projection 55 on a surface of the groove 52 of the locking cylinder 5 as illustrated in FIGS. 10 and 11. When assembled, the piston stem 7 may be rotated such that the cored out locking feature 75 passes over the projection 55 of the groove 52, allowing the projection 55 to spring back into position in an interior of the cored out locking 6 feature 75 to thereby retain the piston stem 7 in a locked position until sufficient force is applied to the piston to overcome the interaction of the projection 55 and an interior of the cored out locking feature 75. Once overcome, the piston stem 7 may be unlocked. In some embodiments, the projection 55 and corresponding cored out locking feature 75 may be configured such that the projection 55 must be broken before the piston stem 7 is unlocked from the lock cylinder 5. An example of a projection 55 according to various embodiments of the invention is illustrated in FIG. 12.

Figure 13:
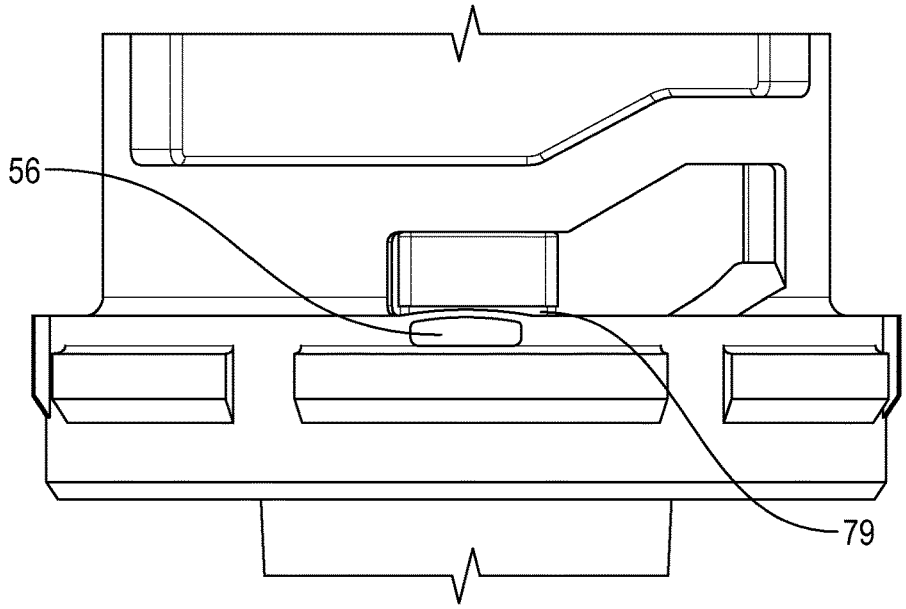
FIG. 13 illustrates a portion of a piston stem and lock cylinder assembly according to various embodiments of the invention.

Another example of a locking system according to embodiments of the invention is illustrated in FIGS. 13 and 1.4. As shown, a lock cylinder 5 may include a leaf spring 56 formation in a surface of the groove 52 of the lock cylinder 5. The leaf spring 56 may be molded such. that an upper portion may flex as the locking tab 72 of the piston stem 7 passes over the leaf spring 56. The leaf spring 56 may apply sufficient force against the locking tab 72 of the piston stem 7 to hold the piston stem 7 in a locked position as illustrated in FIG. 13. As with other embodiments of the invention, the locking tab 72 of the piston stem 7 may include a gap 79 to allow the locking tab 72 to pass over the leaf spring 56. In other embodiments, the size of the gap 79 may be adjusted or selected based on the configuration of the leaf spring 56 to require a certain force to overcome the interaction of the leaf spring 56 with the locking tab 72. In this manner, the force required to unlock the system can be configured or customized based on the desired use.

Figure 14:
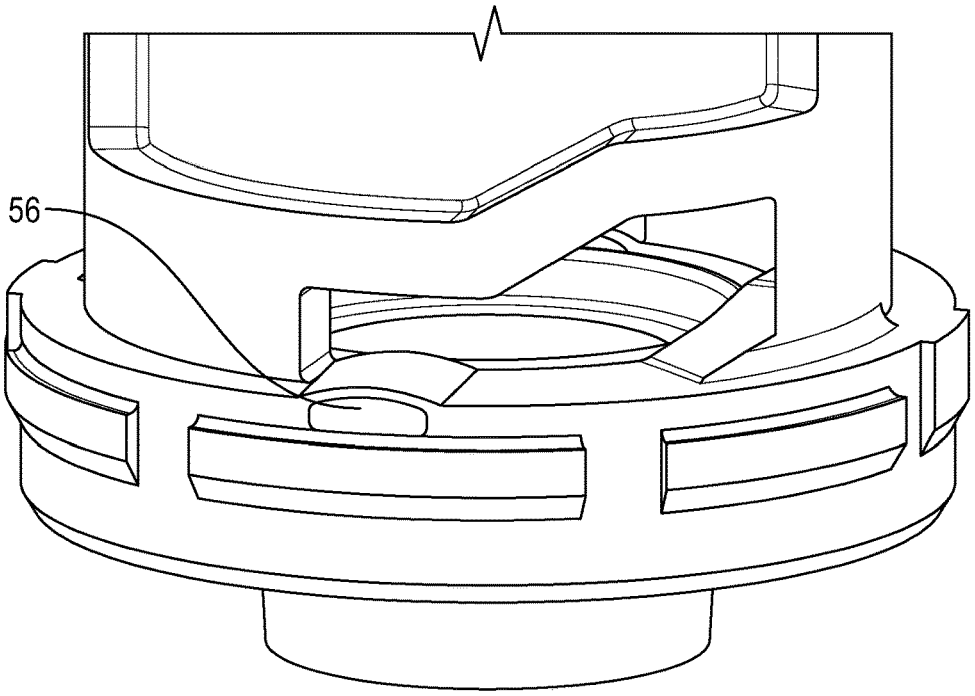
FIG. 14 illustrates a portion of a lock cylinder according to various embodiments of the invention.

While a leaf spring 56 is illustrated in FIGS. 13 and 14 as being on a bottom surface of the groove 52 of a lock cylinder 5, it is understood that the leaf spring 56 could be positioned on an upper surface thereof and the gap 79 in the locking tab 72 of the piston also configured on the upper or lower surface of the locking tab 72.

Figure 15:
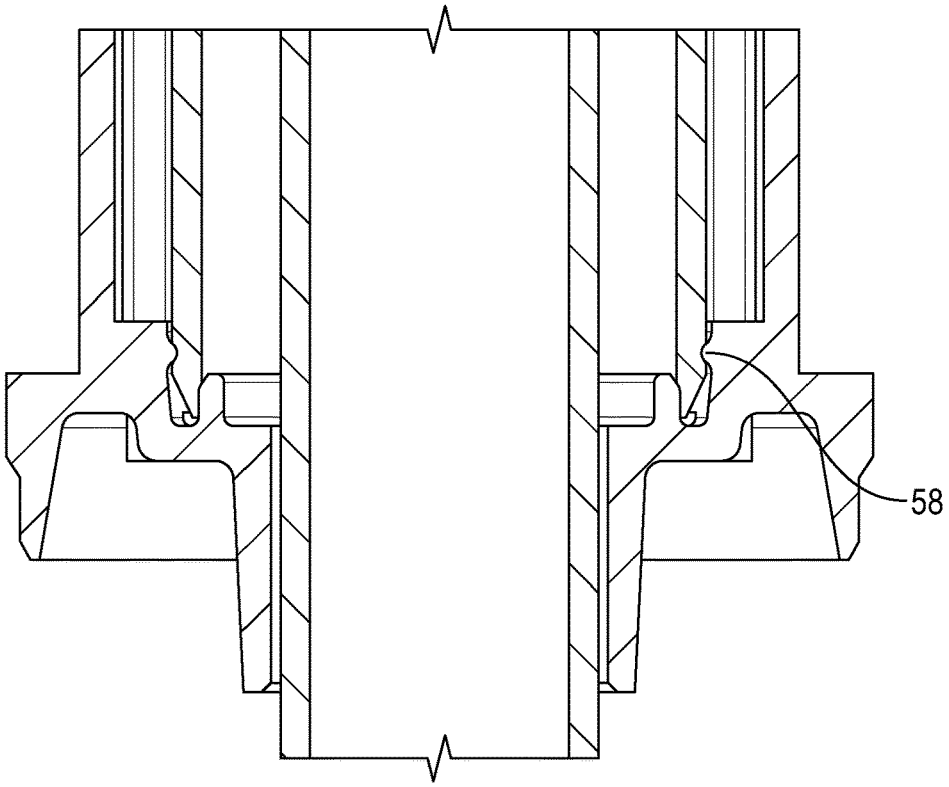
FIG. 15 illustrates a portion of a lock cylinder and piston stem according to various embodiments of the invention.
Figure 16:
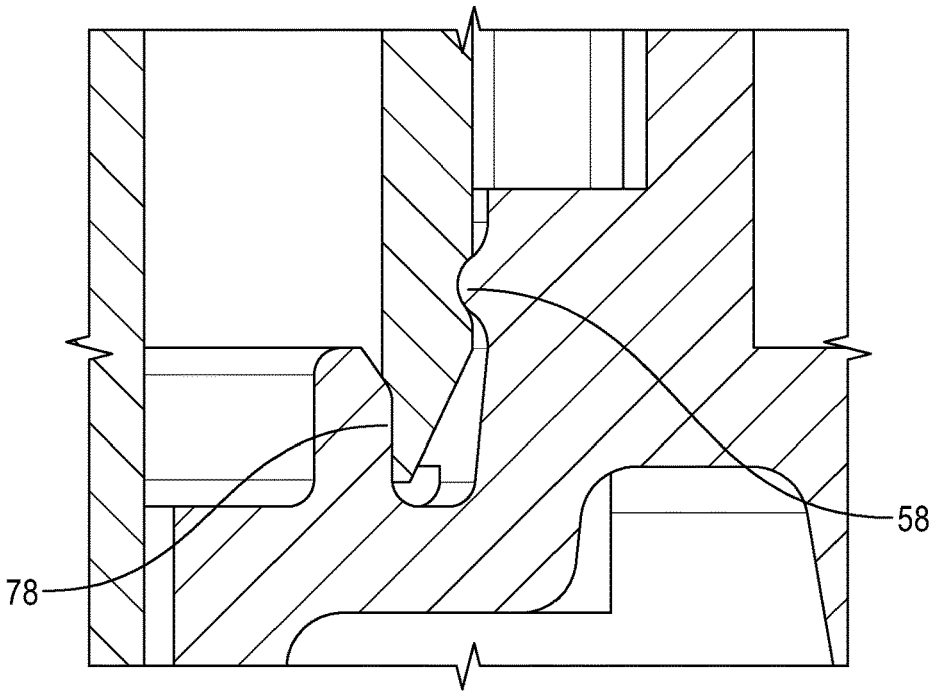
FIG. 16 illustrates a portion of a lock cylinder and piston stem according to various embodiments of the invention.

According to other embodiments of the invention, the force required to unlock a pump system may also be increased by including or creating increased interference between the piston stem 7 and the lock cylinder 5 apart from the locking features therein. For example, as illustrated in FIGS. 15 and 16, an interference bump 58 may be included on an interior surface of the lock cylinder 5 that engages with an exterior surface (groove) of the piston stem 7 when in a locked position. The interaction of the interference bump 58 against the outer portion of the piston stem 7 also helps facilitate a better seal at position 78 between the piston stem 7 and the lock cylinder 7 in the locked configuration, which in turn helps to reduce leakage during shipping of a product utilizing a pump system according to embodiments of the invention.

Figure 17:
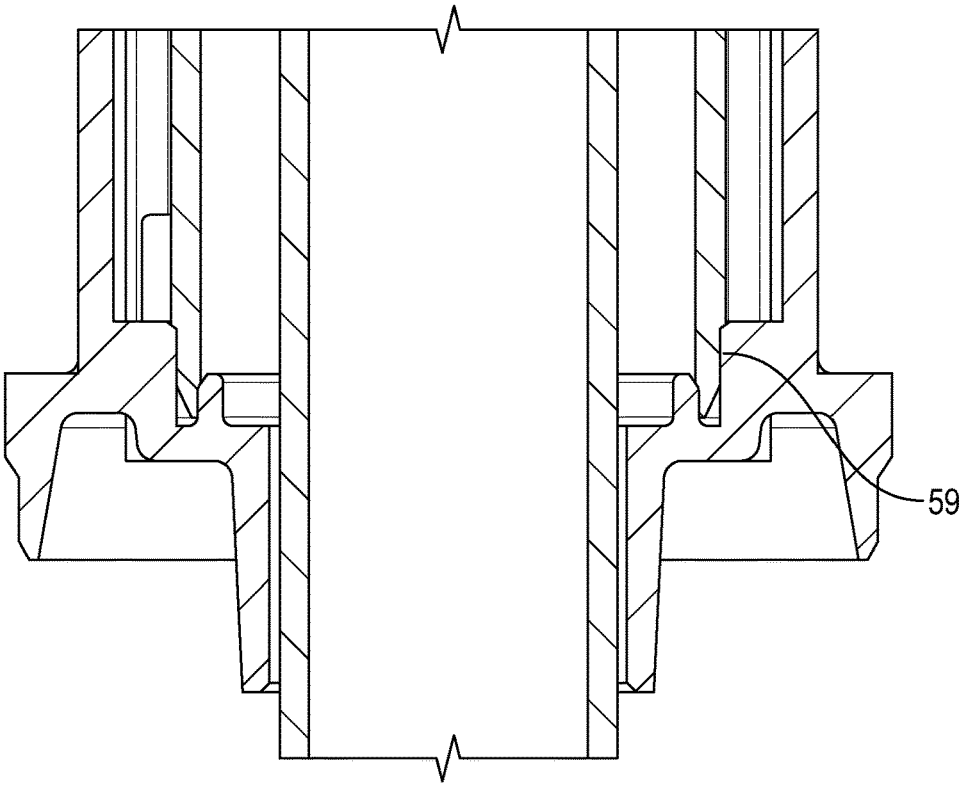
FIG. 17 illustrates a portion of a lock cylinder and piston stem according to various embodiments of the invention.
Figure 18:
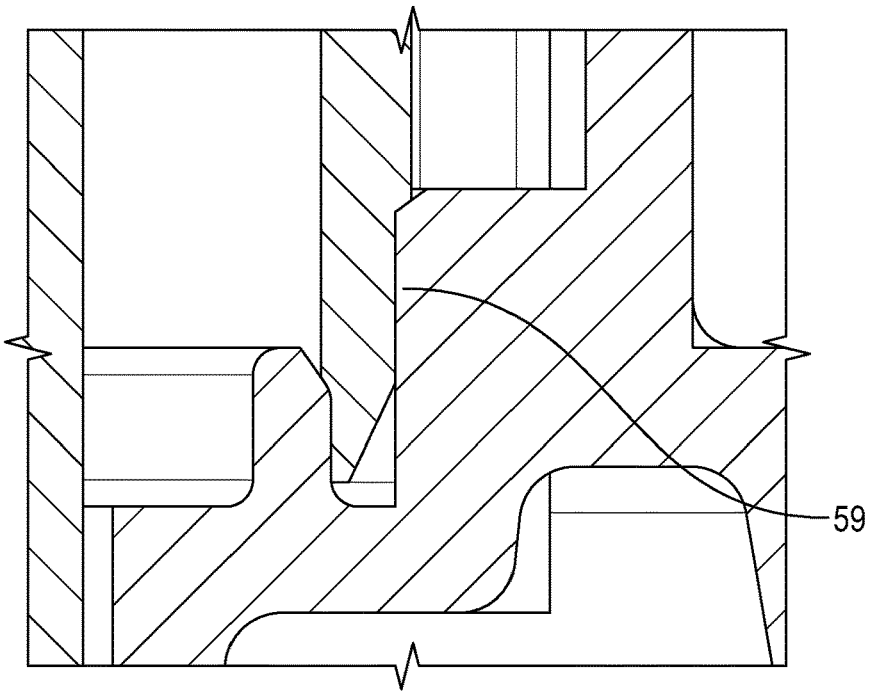
FIG. 18 illustrates a portion of a lock cylinder and piston stem according to various embodiments of the invention.

As illustrated in FIGS. 17 and 18, a wedge formation 59 in the lock cylinder 5 may also help exert a force on the piston stem 7 to increase the force required to unlock the piston stem 7 and to help increase the pressure of the seal between the two parts.

According to still other embodiments of the invention, the amount of rotational force required to unlock a piston stem 7 and lock cylinder 5 may be increased by creating interference between other components of the pump system. For example, a closure 4 may include one or more bumps or other features configured to engage with one or more features of a head 3 to help prevent the rotation of the head 3 about the closure 4 without sufficient force.

In still other embodiments of the invention, a clip system may be included with the pump system, wherein a clip may be configured to attach to the closure 4 and the head 3 to prevent rotation of the head 3 until the clip is removed from the head 3 and/or the closure 4.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A pump system, comprising:

a piston stem having a locking feature;

a lock cylinder having a groove; and a spring projection configured in a surface of the groove, and wherein the locking feature is positioned in the groove.

2. A pump system comprising:

an accumulator cup;

a locking cylinder seated within the accumulator cup, the locking cylinder having a side wall and locking groove within the side wall which extends circumferentially around at least a portion of the side wall; and a piston stem having a body portion coaxially received within the locking cylinder, the piston stem including a locking tab extending radially outward from the body portion, the locking tab received within the locking groove, the piston stem being rotatable relative to the locking cylinder between a locked position and an unlocked position, the locking tab and the locking groove including interacting locking formations which cooperate to increase the force required to move the piston stem from the locked position to the unlocked position, the piston stem being coaxially slidable relative to the locking cylinder and accumulator cup in the unlocked position, and being locked relative to the locking cylinder and accumulator cup in the locked position, wherein the interacting locking formations comprise a spring projection extending from a surface of the locking groove and a recess formed within the locking tab.

3. The pump system of claim 2, wherein there is a gap between the locking tab and the surface of the locking groove.

4. The pump system of claim 2 wherein the spring projection is a leaf spring extending from a surface of the locking groove.

5. A pump system comprising:

an accumulator cup;

a locking cylinder seated within the accumulator cup, the locking cylinder including a circumferential locking rib extending radially inward from an interior surface of the locking cylinder; and a piston stem having a body portion coaxially received within the locking cylinder, the piston stem including a circumferential locking groove on an exterior surface of the piston stem, the locking rib being snap received within the locking groove to retain the piston stem in a locked position.

6. The pump system of claim 5, further comprising:

a locking cylinder groove in the locking cylinder; and a locking tab extending radially outward from the piston stem, wherein the locking tab is positioned in the locking cylinder groove.

* * * * *